US006475308B1

(12) United States Patent
Issartel et al.

(10) Patent No.: US 6,475,308 B1
(45) Date of Patent: Nov. 5, 2002

(54) PROCESS FOR THE PRODUCTION OF A STRIP OF HOT ROLLED STEEL OF VERY HIGH STRENGTH, USABLE FOR SHAPING AND PARTICULARLY FOR STAMPING

(75) Inventors: Christophe Issartel, Arles (FR); Christian Marteau, Saint Gilles (FR); Christian Giraud, Miramas (FR)

(73) Assignee: Unisor, Puteaux (FR)

( * ) Notice: Subject to any disclaimer, the term of this patent is extended or adjusted under 35 U.S.C. 154(b) by 0 days.

(21) Appl. No.: 09/709,482

(22) Filed: Nov. 13, 2000

(30) Foreign Application Priority Data

Nov. 12, 1999 (FR) ..... 99 14187

(51) Int. Cl.[7] ..... C22C 38/18; C22C 38/06; C21D 8/02

(52) U.S. Cl. ..... 148/333; 148/602; 148/661; 148/654; 148/657

(58) Field of Search ..... 148/602, 661, 148/654, 657, 333

(56) References Cited

U.S. PATENT DOCUMENTS 4,502,897 A 3/1985 Morita et al.
5,041,167 A * 8/1991 Miwa ..... 148/12 EA

FOREIGN PATENT DOCUMENTS

EP 0 298 500 12/1988
EP 0 548 950 6/1993
EP 0 586 704 3/1994
EP 0 748 877 12/1996
JP 358167751 A * 10/1983 ..... C22C/38/12
JP 3-10049 1/1991
JP 410195591 A * 7/1998 ..... C22C/38/00

* cited by examiner

*Primary Examiner*—Deborah Yee
(74) *Attorney, Agent, or Firm*—Oblon, Spivak, McClelland, Maier & Neustadt, P.C.

(57) ABSTRACT

Process for the production of a hot rolled metal strip of very high strength, usable for shaping and particularly for stamping, characterized in that a steel of the following weight composition: carbon, 0.12–0.25%; manganese, 1–2%; aluminum, 0.03–2.5%; silicon, 0.03–2%; chromium, 0.04–2%; phosphorus, 0.02–0.09%; sulfur optionally up to 0.01%; titanium up to 0.15%; niobium up to 0.15%; vanadium up to 0.15%; is subjected to:

rolling at a temperature below 880° C.;

a first short cooling, carried out over a time less than 10 seconds, a second controlled cooling with a cooling speed V ref1 comprised between 20° C./sec. and 150° C./sec., the temperature at the end of the second cooling being comprised between 700° C. and 750° C., holding at a temperature level, a third cooling, also controlled, whose speed is comprised between 20° C./sec. and 150° C./sec., the temperature at the end of the third cooling being comprised between 350° C and 550° C.

5 Claims, 1 Drawing Sheet

PROCESS FOR THE PRODUCTION OF A STRIP OF HOT ROLLED STEEL OF VERY HIGH STRENGTH, USABLE FOR SHAPING AND PARTICULARLY FOR STAMPING

The invention concerns a process for the production of a strip of hot rolled steel of very high strength, usable for shaping and particularly for stamping.

In the field of mechanical construction and more particularly of automobiles, the equipment particularly for safety, comfort and energy saving has given rise to research for lightening the weight whilst preserving the properties of durability and service of the stamped pieces. Fatigue strength, in particular, is an essential criterion because it defines the lifetime of these pieces. So as to improve this fatigue strength, one solution consists in the use of very high strength steels. There is effectively a linear relation between the limit of endurance and the mechanical strength. It is thus possible to use metal sheets with reduced thickness, which contributes to lightening the weight whilst keeping unchanged the durability and service. It is nevertheless necessary that the steel be adapted for stamping. However, in general, the properties of shaping decrease with the increase of mechanical resistance.

In the field of hot rolled steels, whose mechanical characteristics are obtained by controlled rolling in a wide strip mill, there exist particularly three types of hot rolled steels having high mechanical characteristics with an elastic limit comprised between 315 MPa and 700 MPa.

The HEL so-called high elastic limit steels, which are micro-alloyed steels having an elastic limit comprised between 315 MPa and 700 MPa, but a limited ability to be shaped, because in particular of an Re/Rm ratio comprised between 0.85 and 0.9.

The Dual-Phase steels, for their part, are steels of martensitic ferritic structure having remarkable shaping properties, but having a level of mechanical resistance not exceeding 600 MPa.

So-called HR steels which are carbon and manganese steels undergoing after rolling a rapid cooling associated with low temperature coiling, to give them a ferrite-bainite structure. These steels have shaping properties intermediate the HEL steels and the Dual-Phase steels. For example, HR steel 55 has a minimum resistance level of 540 MPa, and has a good ability to be stamped, with an Re/Rm ratio comprised between 0.75 and 0.8. Moreover, this steel is weldable and has an excellent ability to be given a shape of the raised flange type. Obtaining a steel of the HR 60 type requires either adding a micro-alloying element, for example niobium, which gives to this steel characteristics near those of an HEL steel, or increasing the carbon or manganese content of the HR 55 type steel, leading to a composition that can give rise to difficulty in the field of resistance welding.

The families of steels mentioned above thus have limits as to their mechanical characteristics and their behavior.

A metallurgical solution to improve the compromise between mechanical resistance and elongation, consists in using TRIP steels of residual ferrite-bainite-austenite structure. In this type of structure, the compromise between mechanical resistance and elongation is substantially improved by the presence, in the microstructure, of residual austenite. It is necessary in this case that the quantity of residual austenite be greater than 5%.

On the other hand, the presence of martensite in such a microstructure prevents improvement of stamping ability because of the presence of residual austenite.

A first possibility for obtaining TRIP steel is the use of steels of a composition of the C—Mn—Si>1% type. These compositions have the drawback of generating the formation of fayalite because of the presence of silicon.

Another possibility is the use of steels of the C—Mn—Al composition type. This composition has insufficient residual austenite.

Obtaining residual austenite is possible only over a cladding temperature range comprised between 350° C. and 400° C., both for steels of the C—Mn—Al TRIP type and for steels of the C—Mn—Si TRIP type.

A coiling temperature below 350° C. gives rise to the appearance of martensite, which particularly degrades the shapeability of the steels. Too high a coiling temperature leads to a purely ferrite-bainite structure without residual austenite, hence without improvement of the ability to be shaped. Thus, the presence of residual austenite must be greater than 5% to obtain an effect on the shapeability of the produced steels. Below this value, its influence is practically nothing.

Industrially, the coiling temperatures in the field mentioned above are particularly difficult to obtain. Thus, the range of coiling temperature between 350° C. and 400° C. corresponds to a region of instability of heat exchange between the steel strip and the cooling water, because of the breaking of the film of steam forming a screen between the hot metal and the cooling water. This phenomenon leads to an abrupt increase of the coefficient of heat exchange in the region in question, which gives rise, on the rolled steel strip, to a heterogeneity of the microstructure, which is prejudicial to the uniformity of the mechanical properties of the finished product. The need to use low coiling temperatures associated with the character of the TRIP compositions gives rise to difficulties in practice. There is thus sought an increase of the coiling temperature so as to enjoy greater ductility at high temperature.

The object of the invention is to perfect a process for the production of a steel strip of the TRIP type of very high strength, having good shaping properties.

The object of the invention relates to a process for the production of a hot rolled steel strip of very high strength, usable for shaping and particularly stamping, which is characterized in that the steel has the following weight composition:

carbon: 0.12–0.25%,
manganese: 1–2%,
aluminum: 0.03–2.5%,
silicon: 0.03–2%,
chromium: 0.04–2%,
phosphorus: 0.02–0.09%,
sulfur optionally up to 0.01%,
titanium up to 0.15%,
niobium up to 0.15%,
vanadium up to 0.15%, balance iron and residual impurities, is subjected to:
rolling at a temperature below 880° C.,
a first short cooling, carried out over a time less than 10 seconds,
a second controlled cooling at a cooling speed V ref1 comprised between 20° C./sec. and 150° C./sec. as a function of the thickness of the rolled steel strip, the temperature at the end of the second cooling being below point Ar3 of the austenite-to-ferrite transformation, the temperature at the end of the second cooling being comprised between 700° C. and 750° C., holding at a temperature level associated with slow cooling, the speed of cooling being comprised between 3° C./sec. and 20° C./sec. to a temperature at the end of the level comprised between 700° C. and 640° C., a third cooling, also controlled, whose speed is comprised between 20° C./sec. and 150° C./sec., which cooling is according to the thickness of the metal strip; the temperature at the end of the third cooling being comprised between 350° C. and 550° C.

The other characteristics of the invention are:

the weight composition comprises less than 0.5% silicon, the coolings are effected in the air, the steel is hot rolled to obtain a hot rolled steel strip whose thickness is comprised between 1.4 mm and 6 mm.

The invention also relates to a hot rolled steel strip obtained by the process comprising in its composition, by weight:

carbon: 0.12–0.25%, manganese: 1–2%, aluminum: 0.03–2.5%, silicon: 0.03–2%, chromium: 0.04–2%, phosphorus: 0.02–0.09%, sulfur: optionally up to 0.01%, titanium: up to 0.15%, niobium: up to 0.15%, vanadium: up to 0.15%, the balance iron and residual impurities.

The other characteristics of the invention are:

the hot rolled steel strip comprises in its weight composition less than 0.05% silicon, the hot rolled strip has a thickness comprised between 1.4 mm and 6 mm.

The description which follows, and the accompanying drawings, are given by way of non-limiting example and will enable comprehension of the invention.

Figure 1:
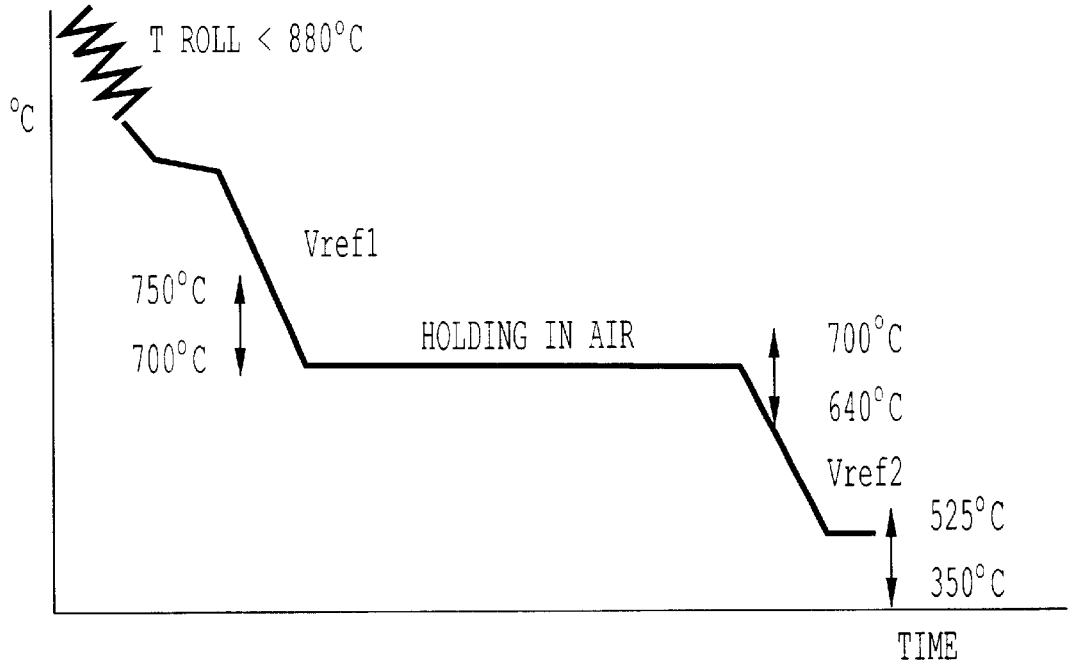
FIG. 1 is a diagram of the cooling of the hot rolled metal strip according to the invention.

According to the invention, a steel whose weight composition is the following:

carbon: 0.12–0.25%, manganese: 1–2%, aluminum: 0.03–2.5%, silicon: 0.03–2%, chromium: 0.04–2%, phosphorus: 0.02–0.09%, sulfur: optionally up to 0.01%, titanium: up to 0.15%, niobium: up to 0.15%, vanadium: up to 0.15%, the rest being iron and residual impurities, is subjected to hot rolling at a temperature below 880° C. so as to refine its cold working.

A first short cooling for example in air, is carried out over time less than 10 seconds to obtain fine grains and to avoid the appearance of a perlite phase in the course of cooling. The steel is then subjected to a second controlled cooling whose speed is comprised between 20° C./sec. and 150° C./sec., this as a function of the thickness of the treated rolled steel strip. The speed of cooling, controlled according to the invention, ensures substantial appearance of the ferritic phase. The temperature at the end of the second cooling is comprised within a temperature interval varying from 700° C. to 750° C., which is to say below the Ar3 point for the formation of austenite in ferrite.

The strip is then maintained at a temperature level at which it is subjected to slow cooling, for example in air, with a cooling speed comprised between 3° C./sec. and 20° C./sec., to reach a temperature at the end of this stage comprised between 700° C. and 640° C. Holding the steel strip at this level ensures the formation of a quantity of ferrite comprised between 40% and 70%. It permits enriching in carbon the residual austenite which has not been transformed into ferrite, slowing its formation in the course of cooling.

The hot rolled steel strip, after holding at the temperature level, is subjected to a third also controlled cooling, whose speed is comprised between 20° C./sec. and 150° C./sec., according to the thickness of the treated metal strip, and this to a temperature comprised between 350° C. and 525° C. so as to complete the enrichment of the residual austenite in the course of the transformation which begins at a temperature of about 640° C.

For example, the speeds of cooling Vref1 and Vref2 are comprised between 20° C./sec. and 50° C./sec. for sheet thicknesses comprised between 4.5 mm and 6 mm and comprised between 50° C./sec. and 150° C./sec. for thicknesses comprised between 1.4 mm and 4.5 mm.

The final structure of the hot rolled steel is composed of ferrite, bainite and residual austenite in a quantity greater than 5%, which permits achieving a mechanical resistance greater than 700 MPa, with values of elongation at yield greater than 10% and elongation at rupture greater than 25%.

As to the elements contained in the composition, according to the invention, carbon stabilizes the austenite. Manganese permits lowering the transformation points Ar3, Bs and Ms corresponding respectively to the temperature at the beginning of ferritic transfer formation, the temperature at the beginning of bainitic transformation and the temperature at the beginning of martensitic transformation.

Aluminum and silicon avoid the diffusion of carbon and ensure stabilization of the austenite by their effect on the carbon. Silicon and aluminum have a same effect complementing each other. It is however preferable to maintain the silicon at low content to avoid the formation of fayalite generating surface defects which appear after pickling. The presence of phosphorus and chromium, alphagenic elements, permits promoting the formation of the ferritic phase in the course of holding at a level temperature. The proportion of ferrite formed is thus important and the enrichment in carbon of the residual austenite permits the stabilization of this phase over a wide temperature range for coiling.

Titanium, niobium and vanadium, which are optionally introduced into the composition, are micro-alloying elements which can be added to the steel composition to obtain precipitation hardening and to refine the grain size of the ferrite. This permits obtaining higher mechanical resistance while slightly reducing the yield elongation.

The steel composition according to the invention permits obtaining a microstructure of the residual ferrite-bainite-austenite type, the hot rolling ensuring on the one hand a good recrystallization of the grains of austenite at the outlet of the roll stand and on the other hand an equiaxial texture.

In an example of use, the steel whose composition is as given in Table 1, is subjected to a temperature treatment according to the invention in which:

the laminating temperature is 850° C., the first air cooling is 1.5 seconds, followed by a second controlled cooling at a speed of 80° C./sec. to a temperature of 720° C., which temperature is below the Ar3, the steel strip obtained is then held at a temperature, in air, at a temperature level at which it is cooled to a temperature of 680° C., the third cooling, also controlled, is carried out at a speed of 80° C./sec. to a temperature corresponding to the coiling temperature, coiling is carried out, in the example, at different temperatures, which are 400° C., 450° C., 500° C., 550° C., 600° C.

TABLE 1

| composition ($x10^{-3}$%) | | | | | | |
|---|---|---|---|---|---|---|
| C | Al | Mn | Si | P | Cr | N |
| 200 | 1330 | 1500 | 250 | 48 | 852 | <2 |

At the different temperatures of coiling, the different mechanical characteristics obtained were measured, as shown in the following tables.

TABLE 2

| Coiling at 400° C. | | | | |
|---|---|---|---|---|
| RpO2 | Rm | Ag* | Re/Rm | n |
| MPa | Mpa | (%) | | (4–8%) |
| 418 | 799 | 14.6 | 0.52 | 0.22 |

Remarks:
Ag* represents the elongation at yield, corresponding to the elongation of the specimen in traction at the time that necking begins to appear.
Rm resistance to rupture of the steel specimen.
Re elastic limit of the steel.
n coefficient of work hardening.

At the level of the microstructure, the bainite is slightly predominant relative to the ferrite, which is present in the form of fine grains. The residual austenite is present in the form of blocks between the ferrite grains, with a mean of 12.8%.

TABLE 3

| Coiling at 450° C. | | | | |
|---|---|---|---|---|
| RpO2 | Rm | Ag | Re/Rm | n |
| MPa | MPa | (%) | | (4–8%) |
| 519 | 728 | 11.9 | 0.71 | 0.20 |

Remarks: The microstructure is ferrite-bainite. There can be observed areas of austenite in the form of strips of bainite. The mean residual austenite is 7%.

TABLE 4

| Coiling at 500° C. | | | | |
|---|---|---|---|---|
| RpO2 | Rm | Ag | Re/Rm | n |
| MPa | MPa | (%) | | (4–8%) |
| 458 | 779 | 14.4 | 0.59 | 0.21 |

Remarks: The microstructure is of the ferrite-bainite type in which the bainite is principally in the form of large areas. The austenite is present essentially in the form of blocks between the grains of ferrite. The mean residual austenite is 9.4%.

TABLE 5

| Coiling at 550° C. | | | | |
|---|---|---|---|---|
| RpO2 | Rm | Ag | Re/Rm | n |
| MPa | MPa | (%) | | (4–8%) |
| 569 | 758 | 9.5 | 0.75 | 0.15 |

Remarks: The microstructure has very little residual austenite, the mean residual austenite being 0/2%.

TABLE 6

| Coiling at 600° C. | | | | |
|---|---|---|---|---|
| RpO2 | Rm | Ag | Re/Rm | n |
| MPa | MPa | (%) | | (4–8%) |
| 487 | 655 | 12.8 | 0.74 | 0.22 |

Remarks: The microstructure is of the ferrite-bainite type and has no residual austenite.

Generally speaking, it will be noted that the steel with a residual ferrite-bainite-austenite microstructure having the following mechanical characteristics: Rm>700 MPa, Re/Rm ratio<0.7, Ag>10% and A%>25%, cannot be produced other than at coiling temperatures comprised between 400° C. and 500° C. thanks to a residual quantity of austenite greater than 5%.

For the two highest coiling temperatures, the quantity of residual austenite is zero or almost zero and the mechanical properties are not in conformity with an acceptable elongation Ag% or with an acceptable rupture limit Rm, the ratio Re/Rm being too high.

Figure 2:
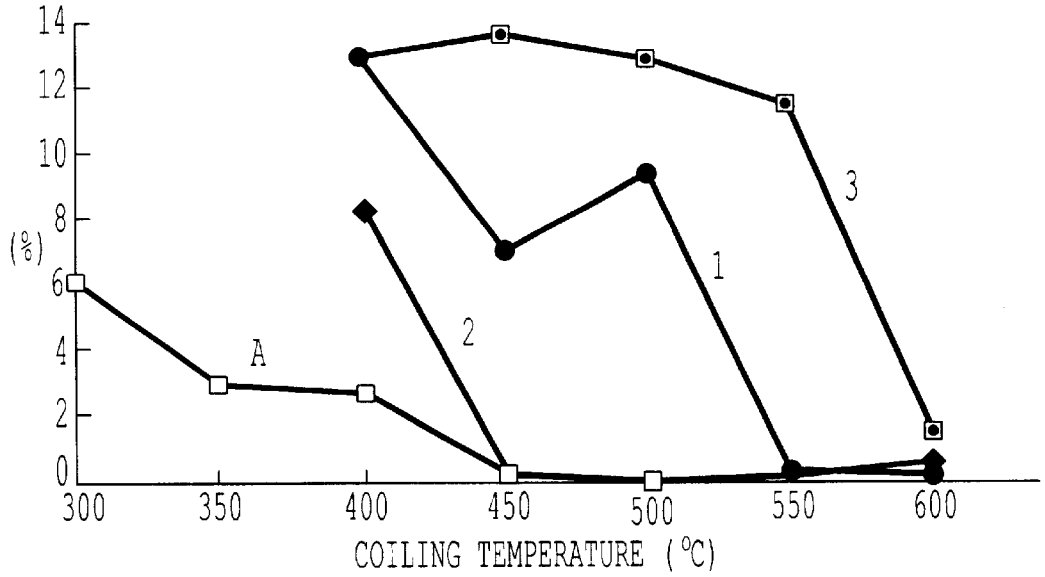
FIG. 2 shows the variation in austenite content as a function of the coiling temperature for examples of steel according to the invention, in comparison with reference TRIP C—Mn—Si and TRIP 0%Cr steels.

FIG. 2 shows the quantity of residual austenite as a function of the coiling temperature for different TRIP steel compositions, as a reference, and according to the invention. It shows that the process according to the invention gives, for example, to steel A taken as a reference, TRIP C—Mn—Si, a greater quantity of austenite for a range of coiling temperature that is wider and higher in temperature. FIG. 2 shows a comparison with steel A to steel 1 for example, and two steels 2 and 3, according to the invention, comprising respectively 0% Cr and 2% Cr. There can be obtained according to the process the desired quantity of austenite over a wide coiling temperature range, which promotes ensuring regularity of the mechanical characteristics of the produced sheet metal, and a regularity without which the use of the sheet metal for a stamped piece would be impossible. The possibility according to the process of coiling at higher temperature permits industrial production of the sheet metal without augmenting the capacities of the industrial equipment.

The proposed invention permits the production of a hot rolled steel strip of a thickness comprised between 1.4 mm and 6 mm, which has both high mechanical strength greater than 700 MPa and good shaping properties, thanks to an Re/Rm ratio less than 0.7, an elongation at yield greater than 10% and an elongation at rupture greater than 25%.

When the silicon content is less than 0.5%, there is obtained a flawless appearance of the surface of the strip after pickling.

According to the invention, the process permits obtaining a hot rolled steel strip comprising a residual ferrite-bainite-austenite structure of greater than 5%, by carrying out in the process an extended coiling over a temperature interval comprised between 350° C. and 525° C. It is thus possible to avoid the temperature range of instability during coiling, below 400° C. This is possible particularly by the use of a basic steel composition with a predetermined chromium and phosphorus content.

The strip of sheet metal according to the invention can be used for stamped, bent or profiled pieces in the mechanical and automotive construction fields. Its use gives the possibility of reducing the thicknesses of the pieces, ensuring their lightening in weight and/or an improvement of their fatigue performance. The pieces can be produced particularly as absorbers, reinforcing members, structural members, wheels requiring high fatigue strength and also good ability to be stamped.

What is claimed is:

1. A process for the production of a hot rolled steel strip, wherein the steel has the following weight composition carbon: 0.12–0.25%, manganese: 1–2%, aluminum: 0.03–2.5%, silicon: 0.03–2%, chromium: 0.04–2%, phosphorus: 0.02–0.09%, sulfur optionally up to 0.01%, titanium up to 0.15%, niobium up to 0.15%, vanadium up to 0.15%, balance iron and residual impurities, wherein said steel is subjected to:

rolling at a temperature below 880° C., a first cooling over a time less than 10 seconds, a second cooling with a cooling speed V ref1 between 20° C./sec. and 150° C./sec. as a function of the thickness of the rolled steel strip, the temperature at the end of said second cooling being below the Ar3 transformation point for austenite to ferrite, the temperature at the end of the second cooling being between 700° C. and 750° C., a third cooling between 3° C./sec. and 20° C./sec. to a temperature between 700° C. and 640° C., a fourth cooling between 20° C./sec. and 150° C./sec. as a function of the thickness of said rolled steel strip, the temperature at the end of said fourth cooling being between 350° C. and 550° C.

2. The process according to claim 1, wherein the weight composition of said steel is less than 0.5% silicon.

3. The process according to claim 1, wherein the coolings are carried out in air.

4. The process according to claim 1, wherein steel is hot rolled to obtain a hot rolled steel strip whose thickness is between 1.4 m and 6 mm.

5. A hot rolled steel strip obtained by the process according to claim 1, having the following weight composition:

carbon: 0.12–0.25%, manganese: 1–2%, aluminum: 1,33–2.5%, silicon: 0.03–2%, chromium: 0.04–2%, phosphorous: 0.02–0.09%, sulfur: optionally up to 0.01%, titanium; up to 0.15%, niobium: up to 0.15%, vanadium: up to 0.15%, the balance iron and residual impurities.

* * * * *

UNITED STATES PATENT AND TRADEMARK OFFICE

CERTIFICATE OF CORRECTION

PATENT NO. : 6,475,308 B1
DATED : November 5, 2002
INVENTOR(S) : Issartel et al.

It is certified that error appears in the above-identified patent and that said Letters Patent is hereby corrected as shown below:

Title page,
Item [73], Assignee, should read:

-- (73) Assignee: Usinor, Puteaux (FR) --

Signed and Sealed this

Twentieth Day of May, 2003

JAMES E. ROGAN
*Director of the United States Patent and Trademark Office*